United States Patent [19]

Gardner

[11] Patent Number: 5,010,632

[45] Date of Patent: Apr. 30, 1991

[54] DESCALING DEVICE

[76] Inventor: Thomas A. Gardner, 22397 Park Edge Cir., Fairview Park, Ohio 44126

[21] Appl. No.: 503,459

[22] Filed: Apr. 2, 1990

[51] Int. Cl.[5] ..... B21C 43/04

[52] U.S. Cl. ..... 29/81.14; 29/81.01; 29/81.12

[58] Field of Search ..... 29/81.14, 81.13, 81.12, 29/81.15, 81.17, 81.01; 173/51, 132, 133

[56] References Cited

U.S. PATENT DOCUMENTS

| | | | |
|---|---|---|---|
| 1,004,617 | 10/1911 | Archer . | |
| 2,356,314 | 8/1944 | Gray et al. | 29/81 |
| 3,150,888 | 7/1964 | Parker | 285/321 |
| 3,343,246 | 9/1967 | Kelley et al. | 29/81.14 |
| 3,349,461 | 10/1967 | Niedwiecki | 29/81 |
| 3,359,611 | 12/1967 | Kelley | 29/81 |
| 3,451,490 | 6/1969 | Troike | 173/31 |
| 3,571,874 | 3/1971 | Von Arx | 29/81 |
| 3,680,643 | 8/1972 | Cameron et al. | 173/133 |
| 3,937,055 | 2/1976 | Caruso et al. | 72/399 |

*Primary Examiner*—Timothy V. Eley
*Assistant Examiner*—R. Martin
*Attorney, Agent, or Firm*—D. Peter Hochberg; Mark Kusner; Louis J. Weisz

[57] ABSTRACT

A descaling tool for use with a reciprocating hammer for removing foreign substances from metal, wood, stone, or the like. The tool is comprised of an elongated shank, one end having an adapter for receipt into a reciprocating hammer, the other having a bore therein for receiving a bundle of elongated, resilient descaling members. The shank is encased by a sleeve and handle assembly which is used to adjust the exposed portion of the descaling members.

10 Claims, 4 Drawing Sheets

DESCALING DEVICE

FIELD OF THE INVENTION

The present invention relates generally to devices for removing rust, scale, slag, paint, cement, or other foreign substances from the surface of metal, wood, stone, or the like, and more particularly, to a device for use with a pneumatic tool for descaling intricate and/or irregular surfaces.

BACKGROUND OF THE INVENTION

The present invention relates generally to a descaling tool for use with a reciprocating hammer for removing foreign substances from metal, wood, stone, or the like. Examples of such devices can be seen in U.S. Pat. Nos. 1,004,617 to Archer; 2,356,314 to Gray et al.; 3,150,888 to Parker; 3,343,246 to Kelly et al.; 3,349,461 to Niedzwiecki; 3,359,611 to Kelley; 3,451,490 to Troike; 3,680,643 to Cameron et al.; and, 3,937,055 to Caruso et al. Each of these patents basically discloses a descaling tool including a plurality of elongated, rigid descaling needles. The descaling needles are typically formed of drill rod or similar tough, hard, elastic steel and have enlarged heads formed at one end thereof. The enlarged heads of the needles are positioned to engage a reciprocating hammer or piston, which is operable to impart axial motion to the needles. The scaling needles are individually mounted for reciprocal movement within a guide or housing which enables each needle to move freely within limits along a predetermined axis. A return spring is typically provided to force the enlarged heads of the needles into engagement with the reciprocating hammer or piston. The descaling operation is performed by the free ends of the needles being repeatedly propelled against the work surface to be cleaned.

While these devices are appropriate for removing scale from welds or cleaning generally planar surfaces, they are generally not suitable for intricate or irregular shapes or contours, such as keyways, gear teeth, or the like. In this respect, the needles of such devices are generally rigid, Which allows them to operate in conjunction with the aforementioned guide or housing. This rigidity, however, does not enable the needles to flex or conform to irregular or intricate shapes. Thus, the aforementioned devices are not particularly suitable for cleaning intricate surfaces having recesses or corners therein. Another problem with such devices is that the impact of the needles against the work surface cannot be controlled and is basically dependent upon the force of the pneumatic tool utilized. In other words, while a given descaling tool may be appropriate for removing heavy deposits on a generally planar surface, it is not suitable for use on detailed or intricate surfaces where a less forceful impact is required.

Several of the aforementioned patents, i.e. U.S. Pat. Nos. 3,359,611 to Kelly and 3,150,888 to Parker disclosed devices having guide sleeves around the needles encasing the return spring, which sleeves are axially adjustable to vary exposure of the needles. These devices, however, require that the sleeve be mechanically repositioned while the tool is inactive; and, more importantly, are provided, not so much to vary the impact of the needles, but rather to maintain their alignment and to vary the return force exerted on the needle housing or sleeve. In this respect, the sleeves or guides on these prior devices are primarily return spring retainers, and confined the ends of the needles in a predetermined pattern. Consequently, they did not provide a means for varying the intensity of the impact of the needles on the workpiece.

These and other problems are overcome by the present invention which provides a descaling device wherein the area of contact between the descaling needles and the workpiece, as well as the intensity of the impact of such needles against the workpiece may be easily adjustable during operation of the tool thereby providing a variable cleaning effect.

SUMMARY OF THE INVENTION

In accordance with the present invention, there is provided a device for removing foreign material from surfaces of metal, wood, stone, or the like. The device is comprised of an elongated shank aligned along a central axis having a first end and a second end. A plurality of elongated descaling members is secured to one end of the shank wherein the descaling members extend longitudinally along the axis. The second end of the shank is adapted to be received in a reciprocating hammer mechanism. Control means for varying the exposure of the descaling members is provided which control means is dimensioned to encase the shank and descaling members and to reciprocally move along such shank.

It is an object of the present invention to provide a device for removing rust, paint, scale, slag, cement, and other foreign substances from the surface of metal, wood, stone, or the like.

Another object of the present invention is to provide a device as defined above, which is operable with conventionally-known pneumatic tools.

Another object of the present invention is to provide a devise as defined above, which is particularly applicable for use on intricate or irregular surfaces.

Another object of the present invention is to provide a device as defined above, which includes a plurality of elongated needles, the ends of which are operable to remove foreign substances from a work surface.

A still further object of the present invention is to provide a device as defined above wherein the area of impact between the ends of the needles and the surface to be cleaned is adjustable.

A still further object of the present invention is to provide a device as defined above wherein the area of impact between the ends of the needles and the surface to be cleaned is adjustable during the operation of the pneumatic tool.

An even further object of the present invention is to provide a device as defined above which is simple to use and inexpensive to manufacture.

These and other objects and advantages will become apparent from the following description of a preferred embodiment of the invention taken together with the accompanying drawings.

DRAWINGS

The invention may take form in certain part and arrangement of parts, the preferred embodiment of which will be described in detail in the specification and illustrated in the accompanying drawings wherein.

Figure 1:
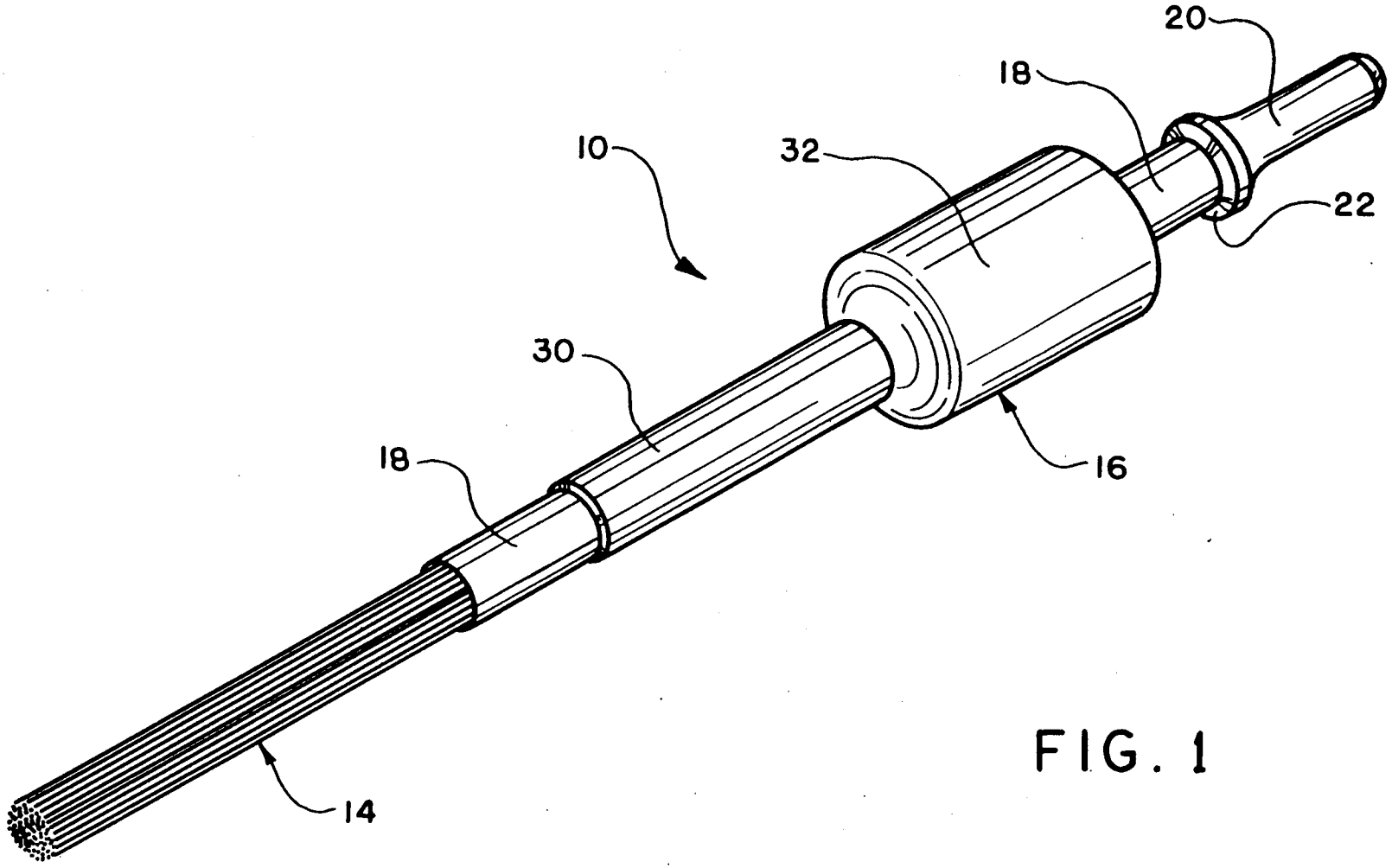
FIG. 1 is a perspective view of a tool for removing foreign substances from generally rigid surfaces illustrating a preferred embodiment of the present invention.
Figure 2:
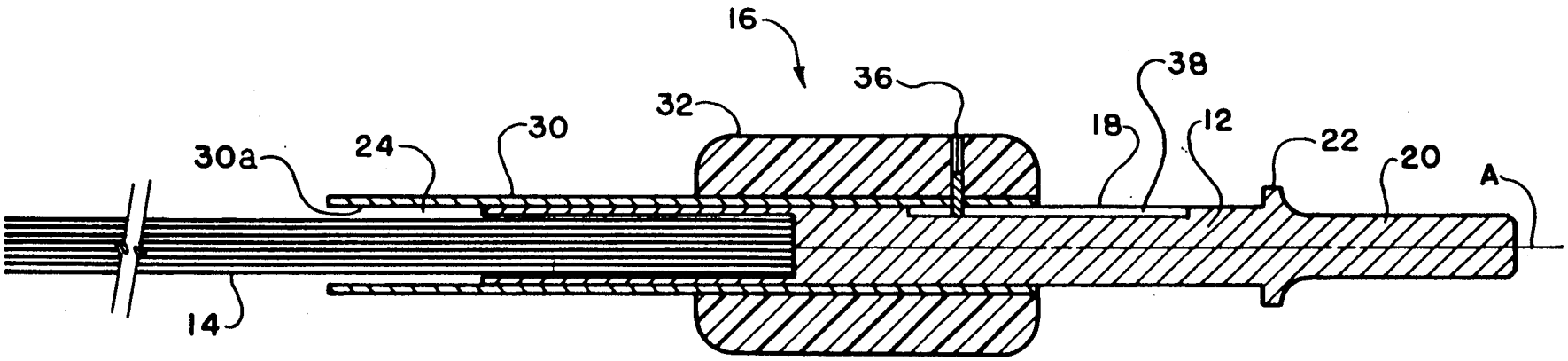
FIG. 2 is a sectional view of the tool shown in FIG. 1.
Figure 3:
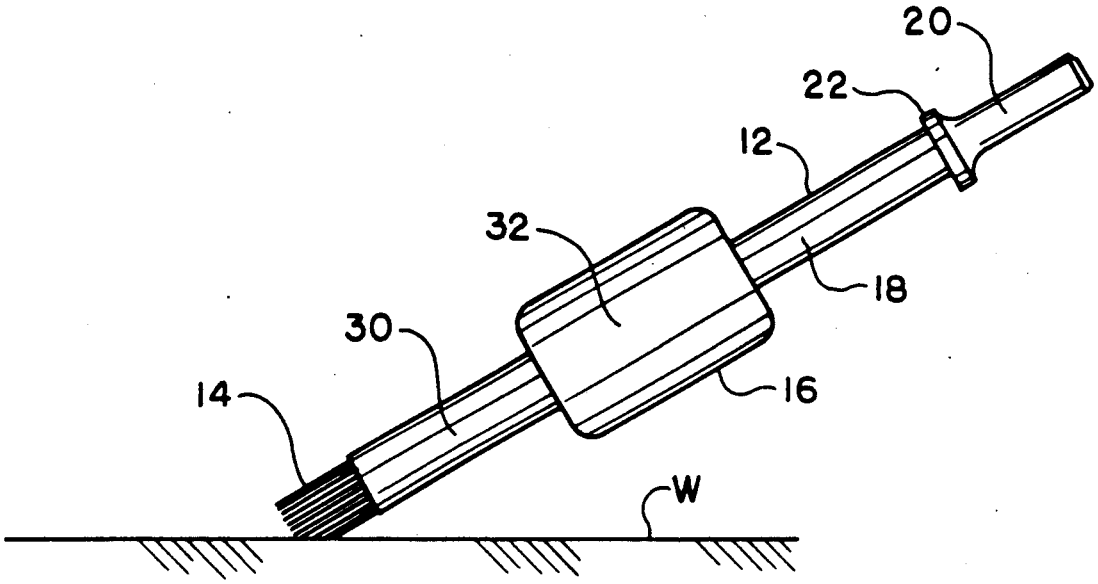
Figure 4:
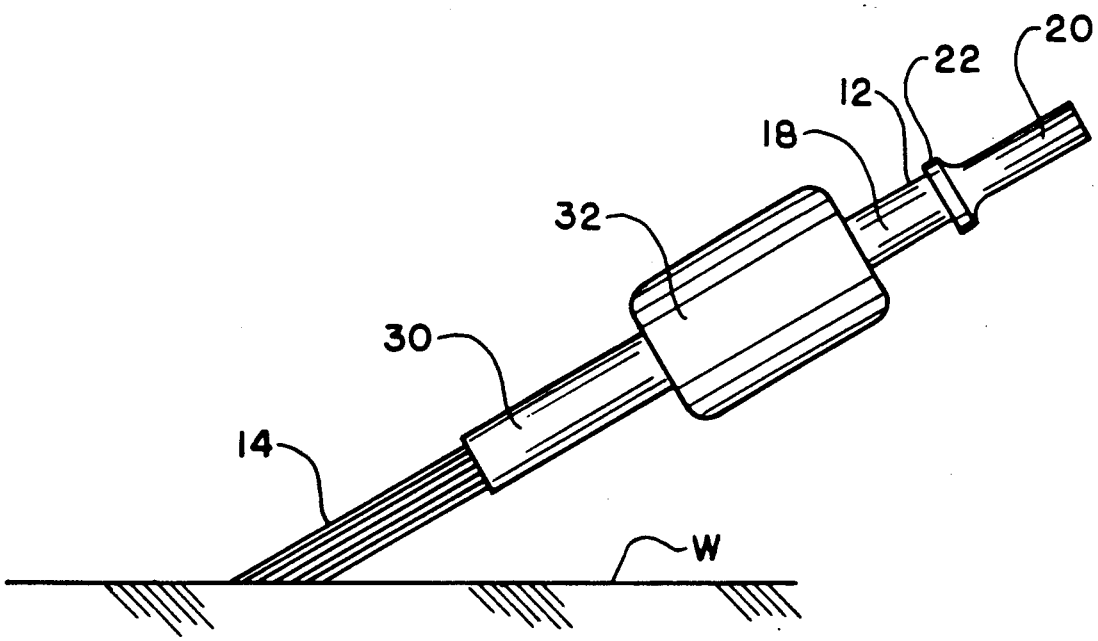
Figure 5:
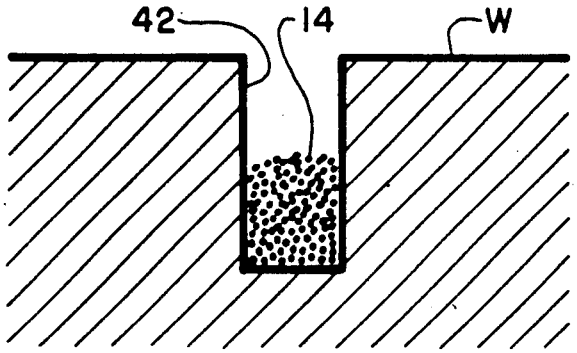
Figure 6:
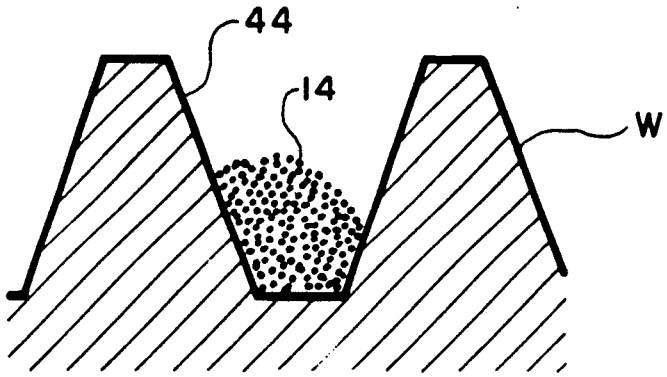
Figure 7:
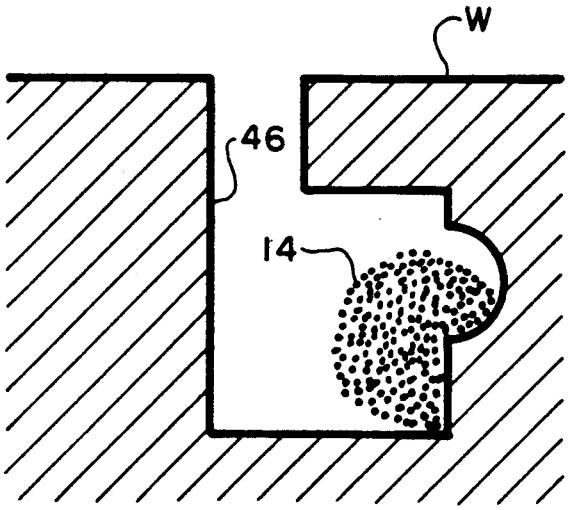

FIGS. 3 and 4 are views illustrating operation of the tool shown in FIGS. 1 and 2; and, FIGS. 5, 6, and 7 are sectional views of workpiece having irregular and intricate shapes further illustrating operation of the present invention.

DETAILED DESCRIPTION OF PREFERRED EMBODIMENT

Referring now to the drawings wherein the showings are for the purpose of illustrating the preferred embodiment of the invention and not for the purpose of limiting same, FIG. 1 discloses a descaling device 10 constructed in accordance with the present invention for removing rust, scale, slag, paint, cement, and other foreign substances from the surface of metal, wood, stone, or the like.

Descaling device 10 is generally comprised of an elongated tool body 12, a plurality of descaling members 14 and a control member 16. Referring now to FIG. 2, tool body 12 includes an elongated shank portion 18 which comprises the major length of tool body 12 and a flared adapter portion 20. An enlarged shoulder 22 is formed at the junction of shank portion 18 and adapter portion 20. In the embodiment shown, shank portion 18 and adapter portion 20 are generally cylindrical in shape and are symmetrical about a central axis A. The free end of shank portion 18 includes a cylindrical bore 24 formed therein, which bore 24 is aligned with axis A and is dimensioned to receive a plurality of descaling members 14. Adapter portion 20 is dimensioned to be received in a reciprocating hammer mechanism (not shown) such as a conventionally-known pneumatic device. In this respect, the shape of adapter portion 20 conforms to conventionally-known standards and need not be described. In the preferred of the present invention, tool body 12 is constructed of a material which is hard enough to resist deformation due to the impact of the pneumatic hammer, yet tempered to resist chipping and/or shattering. Because of its design, tool body 12 lends to screw-machine fabrication. After its fabrication, adapter portion 20 is oil-hardened and tempered to approximately 35–40 on the Rockwell hardness scale. In the embodiment shown, shank portion 12 is approximately 5 inches in length and ½ inch in diameter. Adapter portion 20 is dimensioned to fit in a standard 0.401 inch shank pneumatic hammer which is most widely used in industry and trades. Bore 24 is approximately 2 inches in length and has a 7/16 inch diameter.

Secured within bore 24 of shank portion 18, are a plurality of elongated descaling members 14 which extend longitudinally along central axis A. In the embodiment shown, descaling members 14 are comprised of elongated high-tensile strength steel wire bristles which are bundled together in a close-packed, side-by-side relationship. More specifically, descaling 14 are comprised of tough, hard, elastic wire of relatively small diameter, which wire is flexible, i.e. can deflect, buckle or bow outward when the ends thereof engage a workpiece, but will not deform and has sufficient toughness to maintain its dimensional shape during use. Descaling members 14 can be manufactured in various wire diameter sizes ranging from 0.012 inches through 0.0625 inches. In the preferred embodiment of the present invention, descaling members 14 are formed of wire which is approximately 5 inches in length and 0.025 inches in diameter and is preferably made of high strength steel alloy, which is suitable for general use. Descaling members 14 may be a formed of a stainless steel alloy material when working with stainless steel objects. Such material will not contaminate a workpiece for future operations or welds. Approximately 200 individual descaling members 14 of 0.025 inches diameter can be positioned within bore 24 of 7/16 inches diameter. Means are provided for securing the bundled descaling members 14 in bore 24 of shank portion 18. In the embodiment shown, an epoxy is utilized, which epoxy hardens to form a strong, resilient, impact-resistent bond between the individual descaling members 14 and the inner surface of bore 24 of shank portion 18. One suitable epoxy is manufactured by the 3M Company and designated 2216. As will be appreciated, descaling members 14 may be secured to the end of shank portion 18 by other means such as welding or crimping.

Control member 16 is generally comprised of an enclosed tubular sleeve 30 and a handle 32. The control member 16 operable to be reciprocally movable along shank portion to vary the exposure of descaling members 14. To this end, sleeve 30 of control member 16 has an inner surface profile 30*a* dimensioned to generally match outer surface profile of shank portion 18 plus a clearance factor to allow reciprocal sliding of sleeve 30 on shank portion 18. According to the preferred embodiment, sleeve 30 of control member 16 is approximately 4⅝ inches long and constructed of a mild steel with a wall thickness which is sufficient to resist deformation during use. Handle 32 of control member 16 is provided to enable an operator to grip and control the position of sleeve 30 on shaft 12. In this respect, handle 32 is generally cylindrical in shape and dimensioned to be comfortably held in an operator's hand. Handle 32 is preferably constructed of a resilient, shatterproof plastic that can be molded onto sleeve 30 (or molded as a separate part with sleeve 30 pressed into it). Considerations should be made for the resistance of handle 32 to any solvents to which it might be exposed during the life of the device. In the preferred embodiment of the present invention, handle 32 is approximately 2½ inches in length and 1⅜ inches in diameter and is constructed from nylon. It will be appreciated that handle 32 may be formed or any similar plastic material or metal, such as aluminum. Means for maintaining control member 16 on shank 18 may be provided as shown in FIG. 2, wherein a pin 36 extends through sleeve 30 and handle 32 and is received in an axially extending slot 38 formed in shank 18. Slot 38 is dimensioned to enable pin 36 to move therethrough. In this respect, pin 36 and slot 38 would permit full movement (i.e. adjustment) of control member 16 along shank 18 yet not permit removal therefrom.

Referring now to the operation of the present invention, adapter portion 20 is inserted into a conventionally-known reciprocating hammer (not shown). The actuation of the hammer causes the rapid reciprocal movement of descaling members 14 along central axis A, thus initiating the descaling action of device 10. Kinetic energy from the pneumatic tool is transmitted through tool body 12 to the ends of descaling members 14. As the ends of descaling member 14 engages the work surface, the repetitive impacts of descaling members 14 thereagainst produces the cleaning effect thereon. The length and thickness of descaling members 14 is such so as to allow for varying degrees of buckling and lateral deflection of the members when impacting a work surface. In other words, the ends of descaling members 14 tend to splay out along the surface of the workpiece. As will be appreciated, the greater the deflection or splay-out of the descaling members 14, the lesser the intensity of the impact against the surface of the workpiece. Importantly, the length and flexibility of descaling members 14 together with the free sliding movement of control member 16 along shank portion 18 enables the operator to vary the intensity of the impact of the descaling members 14 on the work surface. In this respect, as best seen in FIGS. 3 and 4, which show descaling device 10 in operation on a generally planar worksurface W, the position of control member 16 along shank portion 18 determines the portion of descaling members 14, which is exposed. As less of descaling members 20 are exposed, the ability of the descaling members to buckle, deflect, or "splay-out" is reduced and the action and force of bundled descaling members 14 is intensified and confined to a smaller area, as illustrated in FIG. 3. This focuses the cleaning action of descaling device 10 for use on impurities that are difficult to remove with conventionally-known descaling devices. As control member 16 is positioned closer to adapter portion 20, as shown in FIG. 4, more of descaling members 14 are exposed allowing the cutting ends of descaling members 14 to splay out (deflect) and to conform to irregular and/or intricate surfaces. In this respect, FIGS. 5, 6, and 7 workpieces W including a keyway 42, a notch within a gear 44, and an irregular contour 46 workpiece respectively. As illustrated in the drawings, the ability of the individual descaling members to splay-out and reposition themselves with respect to each other (when control member 16 is positioned to expose descaling members 14) enables them to conform to these irregular and intricate surface. Importantly, this advantage is possible during operation of the pneumatic tool by merely sliding control member to the appropriate position on shank portion 18 where a desired intensity and splaying or fanning of descaling member 14 is obtained. It has also been found that control member 16 also acts to insulate the vibration of descaling device 10 from the hands of the operator. In this respect, control member 16 remains stationary in the operator's hand as shank portion 18 and descaling members 14 vibrate therein. The ability to hold descaling device 10 near the operating end thereof also provide a greater degree of precision in controlling the device. Still, furthermore, descaling members 14 can be sharpened by grinding the ends flat on a standard bench grinder. In this respect, the length of descaling members 14 provides for a number of sharpenings without affecting the performance of descaling device 10.

The present invention thus provides a descaling device which is suitable for most industrial surface cleaning application and at the same time find advantageous application on irregular and intricate surfaces, or surfaces which require variable impact intensity. Importantly, the present invention permits the afore-mentioned uses by the operator while the pneumatic tool is in operation by merely adjusting the position of control member 16 along shank portion 18. The present invention thus provides a single tool which lends itself to numerous applications without operator "down-time" for tool changes. The increased uses, reduced downtime for tool changes, and application to intricate and irregular surfaces provide a descaling tool unlike those known heretofore.

Modifications and alterations to the tool heretofore described will occur to others upon a reading and understanding of the present specification. For example, it will be appreciated that dimensions to tool 10, i.e. the diameter of shank portion 18 and sleeve 30, can be increased to accommodate more descaling members 14 and/or fit into a larger sized standard pneumatic hammer, or the shape of shank portion 18 and tubular sleeve 30 need not be cylindrical. It is intended that any and all such modifications and alterations to the present invention be included insofar as they come within the scope of the patent as claimed or the equivalents thereof.

Having described the invention, the following is claimed:

1. A device for removing foreign material from surfaces, such as metal, wood, stone, or the like, comprising:

an elongates shank aligned along a central axis having a first end and a second end;

a plurality of elongated descaling members assembled side-by-side in a closely packed bundle;

means for securing said descaling members to said first end of said shank, wherein said descaling members extend longitudinally therefrom along said axis and are movable therewith;

means for attaching said second end of said shank to reciprocating means; and sleeve means having a bore extending therethrough, said bore dimensioned to slidably receive said shank and said descaling member therein, said sleeve means being movable along said shank to vary the portion of said descaling members confined therein.

2. A device as defined in claim 1 wherein said descaling members are comprised of resilient wire having a diameter of approximately 0.025 inches.

3. A device as defined in claim 1 wherein sleeve means is comprised of an elongated tubular sleeve having a first end and second end, wherein said sleeve is dimensioned to receive said shank and be movable thereon along said axis during reciprocal movement of said shank.

4. A device as defined in claim 3 wherein said second end of said sleeve includes a handle portion associated therewith.

5. A device as defined in claim 1 wherein said first end of said shank includes a bore aligned with said central axis for receiving said descaling members.

6. A device as defined in claim 5 wherein said shank and said sleeve are generally cylindrical.

7. A device as defined in claim 5 wherein said descaling members are secured within said bore with an epoxy.

8. A device for removing foreign material from surface, such as metal, wood, stone, or the like, comprising:

an elongated shank aligned along a central axis having a first end and a second end;

a bore within said first end, said bore aligned along said axis;

means for attaching said shank to a reciprocating means provided at said second end; and, a plurality of elongated, resilient, descaling members assembled side-by-side in a closely packed bundle move with said shank, said descaling members dimensioned so as to splay away from the axis of said shank when the ends thereof contact a surface.

9. A device as defined in claim 8 further comprising:

sleeve means having a bore extending therethrough said bore dimensioned to slidably receive said shank and said descaling members therein, said sleeve means being moveable along said shank during reciprocal movement thereof to vary the portion of said descaling members confined within said bore.

10. A device for removing foreign material from surfaces, such as metal, wood, stone, or the like, comprising:

an elongated shank aligned along a central axis having a first end and a second end, said first end including a plurality of elongated, resilient descaling members assembled side-by-side in a closely packed bundle;

an elongated sleeve having an inner bore dimensioned to receive said shank and said descaling member, said sleeve being reciprocally movable along said shank to vary the portion of said descaling members confined therein.

* * * * *